US006078143A

United States Patent [19]

Nerone

[11] Patent Number: 6,078,143

[45] Date of Patent: Jun. 20, 2000

[54] GAS DISCHARGE LAMP BALLAST WITH OUTPUT VOLTAGE CLAMPING CIRCUIT

[75] Inventor: Louis R. Nerone, Brecksville, Ohio

[73] Assignee: General Electric Company, Schenectady, N.Y.

[21] Appl. No.: 09/192,785

[22] Filed: Nov. 16, 1998

[51] Int. Cl.[7] ..... H05B 37/02

[52] U.S. Cl. ..... 315/209 R; 315/224; 315/307; 315/DIG. 7

[58] Field of Search ..... 315/209 R, 224, 315/225, DIG. 7, 307, 291; 310/359, 316

[56] References Cited

U.S. PATENT DOCUMENTS

| | | | |
|---|---|---|---|
| 4,370,600 | 1/1983 | Zansky | 315/224 |
| 4,463,286 | 7/1984 | Justice | 315/219 |
| 4,546,290 | 10/1985 | Kerekes | 315/209 R |
| 4,588,925 | 5/1986 | Fahnrich et al. | 315/101 |
| 4,614,897 | 9/1986 | Kumbatovic | 315/224 |
| 4,647,817 | 3/1987 | Fahnrich et al. | 315/104 |
| 4,677,345 | 6/1987 | Nilssen | 315/209 R |
| 4,692,667 | 9/1987 | Nilssen | 315/209 R |
| 4,937,470 | 6/1990 | Zeller | 307/270 |
| 4,945,278 | 7/1990 | Chern | 315/209 R |
| 5,223,767 | 6/1993 | Kulka | 315/209 R |
| 5,262,699 | 11/1993 | Sun et al. | 315/209 R |
| 5,309,062 | 5/1994 | Perkins et al. | 315/53 |
| 5,341,068 | 8/1994 | Nerone | 315/219 |
| 5,349,270 | 9/1994 | Roll et al. | 315/209 R |
| 5,355,055 | 10/1994 | Tary | 315/209 R |
| 5,382,882 | 1/1995 | Nerone | 315/307 |
| 5,387,847 | 2/1995 | Wood | 315/209 R |
| 5,406,177 | 4/1995 | Nerone | 315/307 |
| 5,514,981 | 5/1996 | Tam et al. | 326/80 |
| 5,796,214 | 8/1998 | Nerone | 315/209 R |
| 5,917,289 | 6/1999 | Nerone et al. | 315/209 R |
| 5,945,783 | 8/1999 | Schultz et al. | 315/291 |
| 5,952,790 | 9/1999 | Nerone et al. | 315/209 R |

OTHER PUBLICATIONS

Nerone et al., "Ballast Circuit for Gas Discharge Lamp," Serial No. 08/897,345, filed Jul. 21, 1997, commonly owned with subject application (attorney docket No. LD 11009).

Nerone, "Dimmable Ballast Circuit with Complementary Converter Switches," Serial No. 09/052504, filed Mar. 31, 1998, commonly owned with subject application (attorney docket No. LD 11034).

*Primary Examiner*—Don Wong
*Assistant Examiner*—Tuyet T. Vo

[57] ABSTRACT

A ballast circuit for a gas discharge lamp includes a d.c.-to-a.c. converter circuit with circuitry for coupling to a resonant load circuit, for inducing a.c. current therein. The converter circuit comprises a pair of switches serially connected between a bus conductor at a d.c. voltage and a reference conductor, the voltage between a reference node and a control node of each switch determining the conduction state of the associated switch. The respective reference nodes of said switches are connected together at a common node through which said a.c. current flows, and the respective control nodes of the switches are connected together. A gate drive arrangement is provided for regeneratively controlling the first and second switches. The arrangement comprises a feedback circuit for providing a feedback signal representing current in the load circuit; a coupling circuit including an inductor for coupling the feedback signal to the control nodes; and a first bidirectional voltage clamp connected between the common node and the control nodes. A second bidirectional voltage clamp is coupled across the inductor in such manner as to limit the positive and negative voltage excursions across the inductor.

10 Claims, 3 Drawing Sheets

GAS DISCHARGE LAMP BALLAST WITH OUTPUT VOLTAGE CLAMPING CIRCUIT

FIELD OF THE INVENTION

The present invention relates to a ballast, or power supply circuit, for a gas discharge lamp of the type using gate drive circuitry to regeneratively control a pair of serially connected, complementary conduction-type switches of a d.c.-to-a.c. converter. More particularly, the invention relates to the use of a clamping circuit to limit the output voltage.

BACKGROUND OF THE INVENTION

U.S. Pat. No. 5,796,214 issued to the present inventor, and co-pending application Ser. No. 09/139,311, filed on Aug. 25, 1998 by Louis R. Nerone and David J. Kachmarik, both assigned to the instant assignee, disclose various ballast circuits for a gas discharge lamp of the type using gate drive circuitry to regeneratively control a pair of serially connected, complementary conduction-type switches of a d.c.-to-a.c. converter. The gate drive circuitry as between the foregoing patent and application differ from each other in some respects, but each includes a coupling circuit including an inductor for coupling a feedback signal to the control nodes of the switches.

It would be desirable to provide a circuit for clamping the output voltage of the foregoing types of ballast circuits. This would prevent overheating of components of a typical output circuit, so as to eliminate blackening or smoking of a ballast housing when a lamp becomes broken, for instance. It also would reduce the peak voltages during lamp starting. Additionally, performance ratings of various components could be reduced, to achieve lower cost, without sacrificing reliability.

It would be desirable to provide a circuit for clamping output voltage that can be made at low cost.

SUMMARY OF THE INVENTION

An exemplary embodiment of the invention provides a ballast circuit for a gas discharge lamp including a d.c.-to-a.c. converter circuit with circuitry for coupling to a resonant load circuit, for inducing a.c. current therein. The converter circuit comprises a pair of switches serially connected between a bus conductor at a d.c. voltage and a reference conductor, the voltage between a reference node and a control node of each switch determining the conduction state of the associated switch. The respective reference nodes of said switches are connected together at a common node through which said a.c. current flows, and the respective control nodes of the switches are connected together. A gate drive arrangement is provided for regeneratively controlling the first and second switches. The arrangement comprises a feedback circuit for providing a feedback signal representing current in the load circuit; a coupling circuit including an inductor for coupling the feedback signal to the control nodes; and a first bidirectional voltage clamp connected between the common node and the control nodes. A second bidirectional voltage clamp is coupled across the inductor in such manner as to limit the positive and negative voltage excursions across the inductor.

The foregoing ballast circuit includes the second bidirectional voltage clamp for limiting output voltage. Beneficially, inexpensive Zener diodes can be used for such clamp.

DETAILED DESCRIPTION OF THE INVENTION

Figure 1:
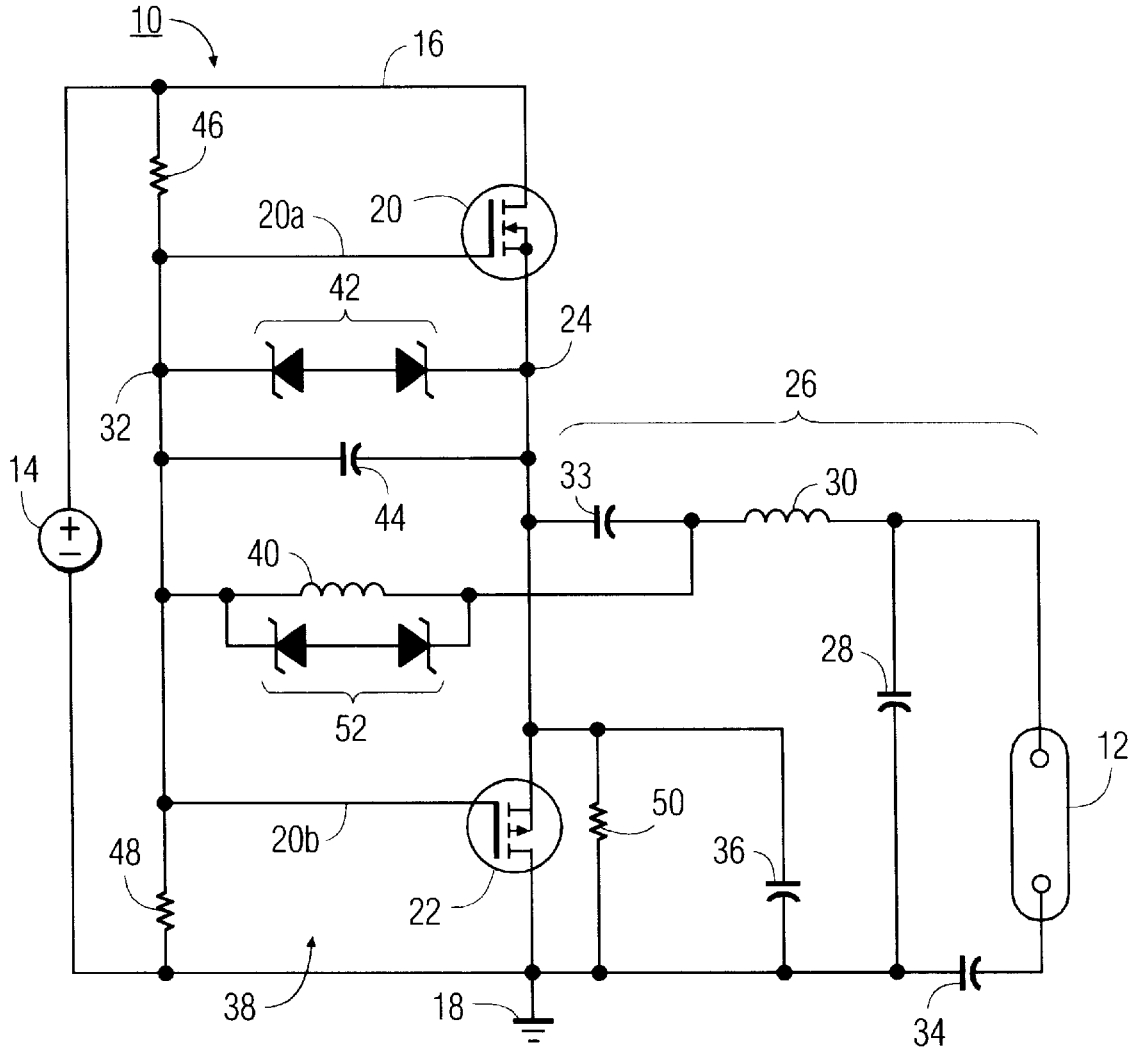
FIG. 1 is a schematic diagram of one embodiment of a ballast circuit in accordance with the invention.

FIG. 1 shows a ballast circuit 10 in accordance with the present invention. A gas discharge lamp 12, such as a fluorescent lamp, is powered from a d.c. bus voltage provided by a source 14 and existing between a bus conductor 16 and a reference conductor 18, after such voltage is converted to a.c. Switches 20 and 22, serially connected between conductors 16 and 18, are used in this conversion process. When the switches comprise n-channel and p-channel enhancement mode MOSFETs, respectively, the source electrodes of the switches are preferably connected directly together at a common node or conductor 24. The switches may comprise other devices having complementary conduction modes, such as PNP and NPN Bipolar Junction Transistors.

An exemplary resonant load circuit 26 includes lamp 12. A resonant capacitor 28 and a resonant inductor 30 determine frequency of resonance of the load circuit. Circuit 26 also includes a feedback capacitor 33 and a d.c. blocking capacitor 34. A conventional snubber capacitor 36 causes switches 20 and 22 to switch softly.

Switches 20 and 22 cooperate to provide a.c. current from common node 24 to load circuit 26. The gate, or control, electrodes 20*a* and 22*a* of the switches preferably are directly connected together at a control node or conductor 32. Gate drive circuitry, generally designated 38, is connected between nodes 24 and 32, for regeneratively controlling the switches. A feedback signal from the right-hand shown lead of feedback capacitor 33 is coupled to control node 32, preferably via an inductor 40. In addition to providing the feedback signal, capacitor 33 is also used during circuit start-up, as described below.

A bidirectional voltage clamp 42 connected between nodes 24 and 32, such as the back-to-back Zener diodes shown, helps to cause the phase angle between the fundamental frequency component of voltage across load circuit 26 (e.g., from common node 24 to reference node 18) and the a.c. current in resonant inductor 30 to approach zero during lamp ignition.

A capacitor 44 is preferably provided between nodes 24 and 32 to predictably limit the rate of change of control voltage between such nodes. This beneficially assures, for instance, a dead time interval during switching of switches 20 and 22 wherein both switches are off between the times of either switch being turned on.

Serially connected resistors 46 and 48 cooperate with a resistor 50 for starting regenerative operation of gate drive circuit 38. In the starting process, capacitor 33 becomes charged upon energizing of source 14, via resistors 46, 48 and 50. Initially, the voltage across capacitor 33 is zero, and, during the starting process, inductor 40 provides a low impedance charging path. With resistors 46–50 being of equal value, for instance, the voltage on node 24, upon initial bus energizing, is approximately ⅓ of bus voltage 14, and the voltage at node 32, between resistors 46 and 48 is ⅓ bus voltage 14. In this manner, capacitor 33 becomes increasingly charged, from right to left as shown, until it reaches the threshold voltage of the gate-to-source voltage of upper switch 20 (e.g., 2–3 volts). At this point, the upper switch starts conducting, which then results in current being supplied by that switch to load circuit 26. In turn, the resulting current in the load circuit causes regenerative control of switches 20 and 22.

Typically, during steady state operation of ballast circuit 10, d.c. current is blocked from flowing through capacitor 33 by d.c. blocking capacitor 34. This prevents capacitor 32 from building up a d.c. component of offset voltage that could prematurely turn on one of the switches.

Rather than using resistor 50, an alternative resistor (not shown) may be placed in shunt across switch 20 rather than across switch 22. The operation of the resulting circuit is similar to that described above. However, initially, common node 24 assumes a higher potential than node 32, so that capacitor 32 becomes charged from left to right as shown. The results in an increasingly negative voltage between node 32 and node 24, which turns on switch 22 first.

Resistors 46 and 48 are both preferably used in the circuit of FIG. 1; however, the circuit functions substantially as intended with resistor 48 removed and using resistor 50. Starting might be somewhat slower and at a higher line voltage. The circuit also functions substantially as intended with resistor 46 removed and using the mentioned alternative resistor (not shown) shunting switch 20.

In accordance with an aspect of the claimed invention, a bidirectional voltage clamp 52 is coupled across inductor 40 in such a way as to limit the positive and negative voltage excursions across the inductor. Preferably, it shunts the inductor. Its voltage rating should be sufficiently above that of the control voltage for the switches between nodes 32 and 24 so it does not conduct during normal ballast operation. Setting its voltage rating to double the control voltage has been found sufficient in various embodiments.

Voltage clamp 52 limits the voltage across the lamp during starting and during lamp operation. If the lamp fails from, for instance, its glass envelope breaking, clamp 52 limits the lamp voltage so that resonant capacitor 28, typically of ceramic, does not overheat and blacken the ballast housing or cause the housing to heat to a smoking condition. Beneficially, the input part of the ballast is more likely to break down more quickly, as for example, by switches 20 and 22 becoming overheated and short-circuited. As such, the ballast can no longer supply power to the lamp, so the lamp and ballast combination can fail without deleterious overheating in the resonant capacitor, for instance.

Design tolerances of the ballast can be relaxed, reducing component cost. For instance, because there is less stress on the resonant capacitor, a capacitor with a lower rating can be used. Because the peak current of the ballast is lowered, the current rating of the switches can be lowered. Similarly, the resonant inductor can be designed for a lower peak current.

Beneficially, the increase in cost of the ballast circuit by including Zener diodes for implementing clamp 52 is typically negligible. Clamp 52 can be embodied in other ways as will be apparent to those of ordinary skill in the art.

Figure 2:
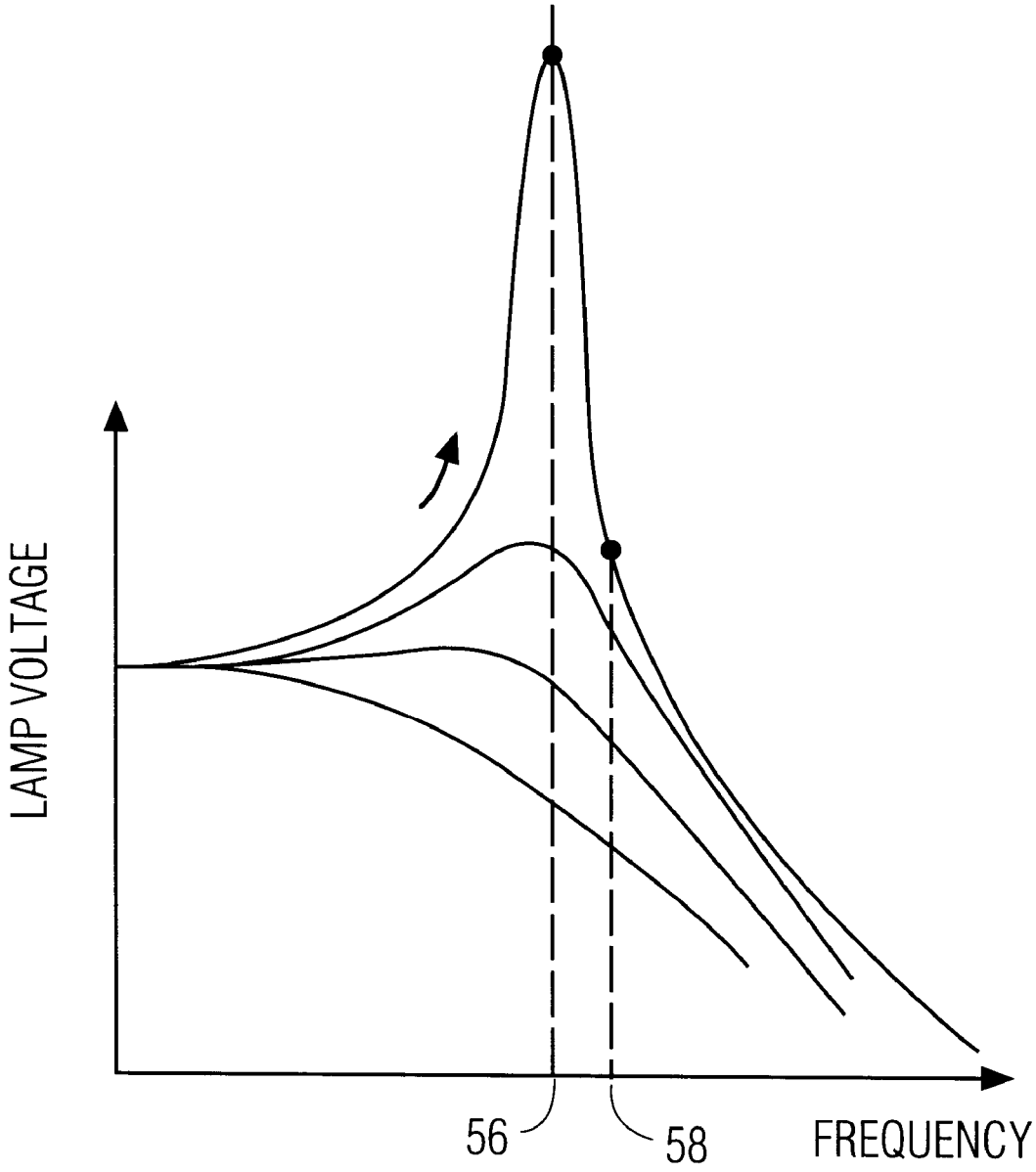
FIG. 2 is a graph of lamp voltage versus operating frequency.

FIG. 2 shows how lamp voltage varies as a function of frequency of operation. Without clamp 52, output voltage may be at frequency point 56. With clamp 52, the frequency of operation is increased because, by shunting inductor 40, clamp 42 allows capacitor 44 to charge and discharge more quickly. This causes the output voltage to be limited to that at frequency point 58.

Exemplary component values for the circuit of FIG. 1 are as follows for a fluorescent lamp 12 rated at 11 watts, with a resistance of about 250 ohms, and with a d.c. bus voltage of 300 volts:

| | |
|---|---|
| Resonant inductor 30 | 2.7 millihenries |
| Resonant capacitor 28 | 2.2 nanofarads |
| Capacitor 33 | 33 nanofarads |
| D.c. blocking capacitor 34 | 100 nanofarads |
| Inductor 40 | 820 microhenries |
| Capacitor 44 | 3.3 nanofarads |
| Capacitor 36 | 470 picofarads |
| Zener diodes 42, each | 10 volts |
| Zener diodes 52, each | 24 volts |
| Resistors 46, 48 and 50, each | 560 k ohms |

Further, switch 20 may be an IRFR310, n-channel, enhancement mode MOSFET, sold by International Rectifier Company, of El Segundo, Calif.; and switch 22, an IRFR9310, p-channel, enhancement mode MOSFET also sold by International Rectifier Company.

Figure 3:
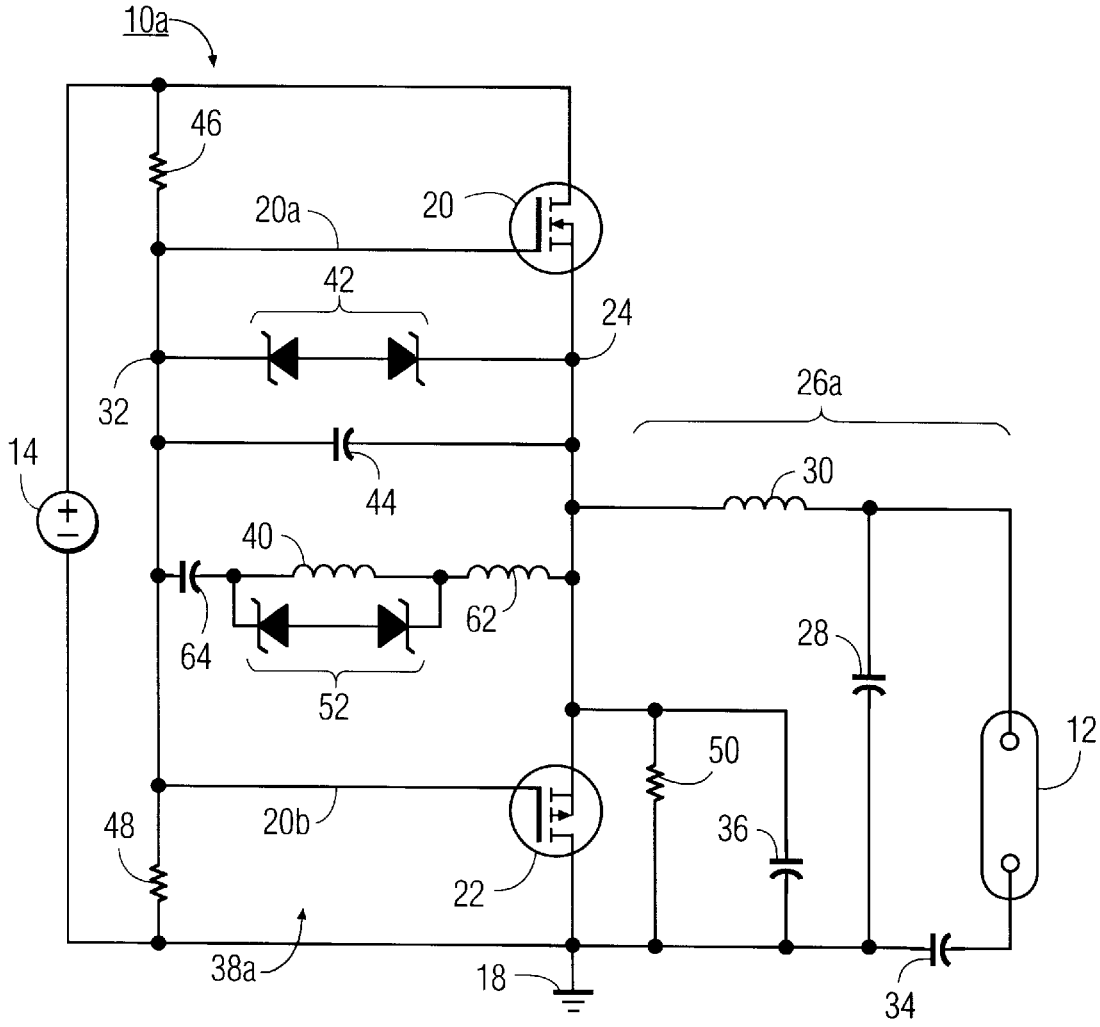
FIG. 3 is a schematic diagram of another embodiment of a ballast circuit in accordance with the invention.

FIG. 3 shows a ballast circuit 10*a* similar to FIG. 1, but employing different gate drive circuitry 38*a*. Like-numbered parts as between FIGS. 1 and 3 refer to similar parts, and description of such parts in FIG. 3 will largely be omitted.

In FIG. 3, a feedback inductor 62 is mutually coupled to resonant inductor 30 with polarity as shown by the associated dots for sensing current in load circuit 26*a*. The feedback signal in inductor 62 is coupled to node 32 by inductor 40 and capacitor 64. Serially connected resistors 46 and 48 cooperate with a resistor 50 for starting regenerative operation of gate drive circuit 38*a*. In the starting process, capacitor 64 becomes charged upon energizing of source 14, via resistors 46, 48 and 50. Initially, the voltage across capacitor 64 is zero, and, during the starting process, inductors 40 and 62 provide a low impedance charging path. With resistors 46–50 being of equal value, for instance, the voltage on node 24, upon initial bus energizing, is approximately ⅓ of bus voltage 14, and the voltage at node 32 is ⅓ bus voltage 14. In this manner, capacitor 64 becomes increasingly charged, from left to right as shown, until it reaches the threshold voltage of the gate-to-source voltage of upper switch 20 (e.g., 2–3 volts). At this point, the upper switch starts conducting, which then results in current being supplied by that switch to load circuit 26*a*. In turn, the resulting current in the load circuit causes regenerative control of switches 20 and 22.

The modifications to resistors 46–50 described above concerning ballast 10 of FIG. 1 apply also to ballast 10*a* of FIG. 3.

Exemplary component values for the circuit of FIG. 3 are as follows for a fluorescent lamp 12 rated at 28 watts, with a resistance of about 580 ohms, and with a.d.c. bus voltage of 150 volts:

| | |
|---|---|
| Resonant inductor 30 | 600 microhenries |
| Feedback inductor 62 | 1.85 microhenries |
| Turns ratio between inductors 30 and 62 | 18 |
| Resonant capacitor 28 | 4.7 nanofarads |
| D.c. blocking capacitor 34 | 220 nanofarads |
| Capacitor 36 | 470 picofarads |
| Inductor 40 | 470 microhenries |
| Capacitor 44 | 1.5 nanofarads |
| Zener diodes 42, each | 10 volts |
| Zener diodes 52, each | 24 volts |
| Resistors 46, 48 and 50, each | 270 k ohms |
| Capacitor 64 | 100 nanofarads |

Switch 20 may be an IRXR214, n-channel, enhancement mode MOSFET, sold by International Rectifier Company, of El Segundo, Calif.; and switch 22, an IRFR9214, p-channel, enhancement mode MOSFET also sold by International Rectifier Company.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. A ballast circuit for a gas discharge lamp, comprising:

(a) a d.c.-to-a.c. converter circuit with means for coupling to a resonant load circuit, for inducing a.c. current therein, said converter circuit comprising:

(i) a pair of switches serially connected between a bus conductor at a d.c. voltage and a reference conductor, the voltage between a reference node and a control node of each switch determining the conduction state of the associated switch;

(ii) the respective reference nodes of said switches being connected together at a common node through which said a.c. current flows, and the respective control nodes of said switches being connected together;

(b) a gate drive arrangement for regeneratively controlling said first and second switches, said arrangement comprising:

(i) a feedback circuit for providing a feedback signal representing current in said load circuit;

(ii) a coupling circuit including an inductor for coupling said feedback signal to said control nodes; and (iii) a first bidirectional voltage clamp connected between said common node and said control nodes; and (c) a second bidirectional voltage clamp coupled across said inductor in such manner as to limit the positive and negative voltage excursions across said inductor, and in such manner as to increase frequency of operation above a minimum frequency point and thereby limit the positive and negative voltage excursions across said lamp to the output voltage at said minimum frequency.

2. The ballast circuit of claim 1, wherein said second voltage clamp is shunted across said inductor.

3. The ballast circuit of claim 1, wherein said feedback circuit comprises a capacitor coupled at one end to said common node in such manner as to conduct load current, and coupled at another end to said inductor.

4. The ballast circuit of claim 1, wherein:

(a) said load circuit includes a resonant inductor; and (b) said feedback circuit comprises a feedback inductor mutually coupled to said resonant inductor in such manner as to induce a voltage therein proportional to said a.c. load current; said feedback inductor coupled between said common node and said control nodes.

5. The ballast circuit of claim 1, wherein said inductor cooperates with said first bidirectional voltage clamp in such manner that the phase angle between the fundamental frequency component of voltage across said load circuit and said a.c. load current approaches zero during lamp ignition.

6. A ballast circuit for a gas discharge lamp, comprising:

(a) a d.c.-to-a.c. converter circuit with means for coupling to a resonant load circuit, for inducing a.c. current therein, said converter circuit comprising:

(i) a pair of switches serially connected between a bus conductor at a d.c. voltage and a reference conductor, the voltage between a reference node and a control node of each switch determining the conduction state of the associated switch;

(ii) the respective reference nodes of said switches being connected together at a common node through which said a.c. current flows, and the respective control nodes of said switches being connected together;

(b) a gate drive arrangement for regeneratively controlling said first and second switches, said arrangement comprising:

(i) a feedback circuit for providing a feedback signal representing current in said load circuit;

(ii) a coupling circuit including an inductor for coupling said feedback signal to said control nodes; and (iii) a first bidirectional voltage clamp connected between said common node and said control nodes; and (c) a second bidirectional voltage clamp coupled across said inductor in such manner as to limit the positive and negative voltage excursions across said inductor, and in such manner as to increase frequency of operation above a minimum frequency point and thereby limit the positive and negative voltage excursions across said lamp to the output voltage at said minimum frequency, said second clamp comprising a pair of Zener diodes connected together in back-to-back manner.

7. The ballast circuit of claim 6, wherein said second voltage clamp is shunted across said inductor.

8. The ballast circuit of claim 6, wherein said feedback circuit comprises a capacitor coupled at one end to said common node in such manner as to conduct load current, and coupled at another end to said inductor.

9. The ballast circuit of claim 6, wherein:

(a) said load circuit includes a resonant inductor; and (b) said feedback circuit comprises a feedback inductor mutually coupled to said resonant inductor in such manner as to induce a voltage therein proportional to said a.c. load current; said feedback inductor coupled between said common node and said control nodes.

10. The ballast circuit of claim 6, wherein said inductor cooperates with said first bidirectional voltage clamp in such manner that the phase angle between the fundamental frequency component of voltage across said load circuit and said a.c. load current approaches zero during lamp ignition.

* * * * *